US006918681B2

(12) United States Patent
Brizzie

(10) Patent No.: US 6,918,681 B2
(45) Date of Patent: Jul. 19, 2005

(54) SELF-ILLUMINATING OIL CANDLE

(76) Inventor: Marsha P. Brizzie, 10249 Demaret Dr., Fountain Hills, AZ (US) 85268

( * ) Notice: Subject to any disclaimer, the term of this patent is extended or adjusted under 35 U.S.C. 154(b) by 0 days.

(21) Appl. No.: 10/287,902

(22) Filed: Nov. 6, 2002

(65) Prior Publication Data

US 2004/0085760 A1 May 6, 2004

(51) Int. Cl.[7] ..... F21V 35/00; F23D 3/02
(52) U.S. Cl. ..... 362/161; 362/806; 431/321
(58) Field of Search ..... 362/159, 160, 362/161, 392, 806, 172–173, 182; 431/320, 321, 126

(56) References Cited

U.S. PATENT DOCUMENTS 3,994,672 A * 11/1976 Novak ..... 431/320
4,511,952 A * 4/1985 Vanbragt ..... 362/181
5,541,824 A * 7/1996 Perkins ..... 362/312
6,129,771 A * 10/2000 Ficke et al. ..... 44/275
6,347,879 B1 * 2/2002 Prado ..... 362/159
6,426,051 B1 * 7/2002 Allison ..... 422/125
2001/0016305 A1 * 8/2001 Chen ..... 431/324
2001/0038987 A1 * 11/2001 Jun ..... 431/126

* cited by examiner

*Primary Examiner*—Ali Alavi

(57) ABSTRACT

The invention provides an oil candle comprising a glass container which holds a decorative arrangement which is immersed in candle oil. The container is closed at its top by a transparent beveled glass closure which is provided with a center hole. A glass enclosed wick extends from above the glass enclosure (usually a disc) into the oil within the container. When the wick is lit, the flame brightly illuminates the decorative arrangement.

2 Claims, 1 Drawing Sheet

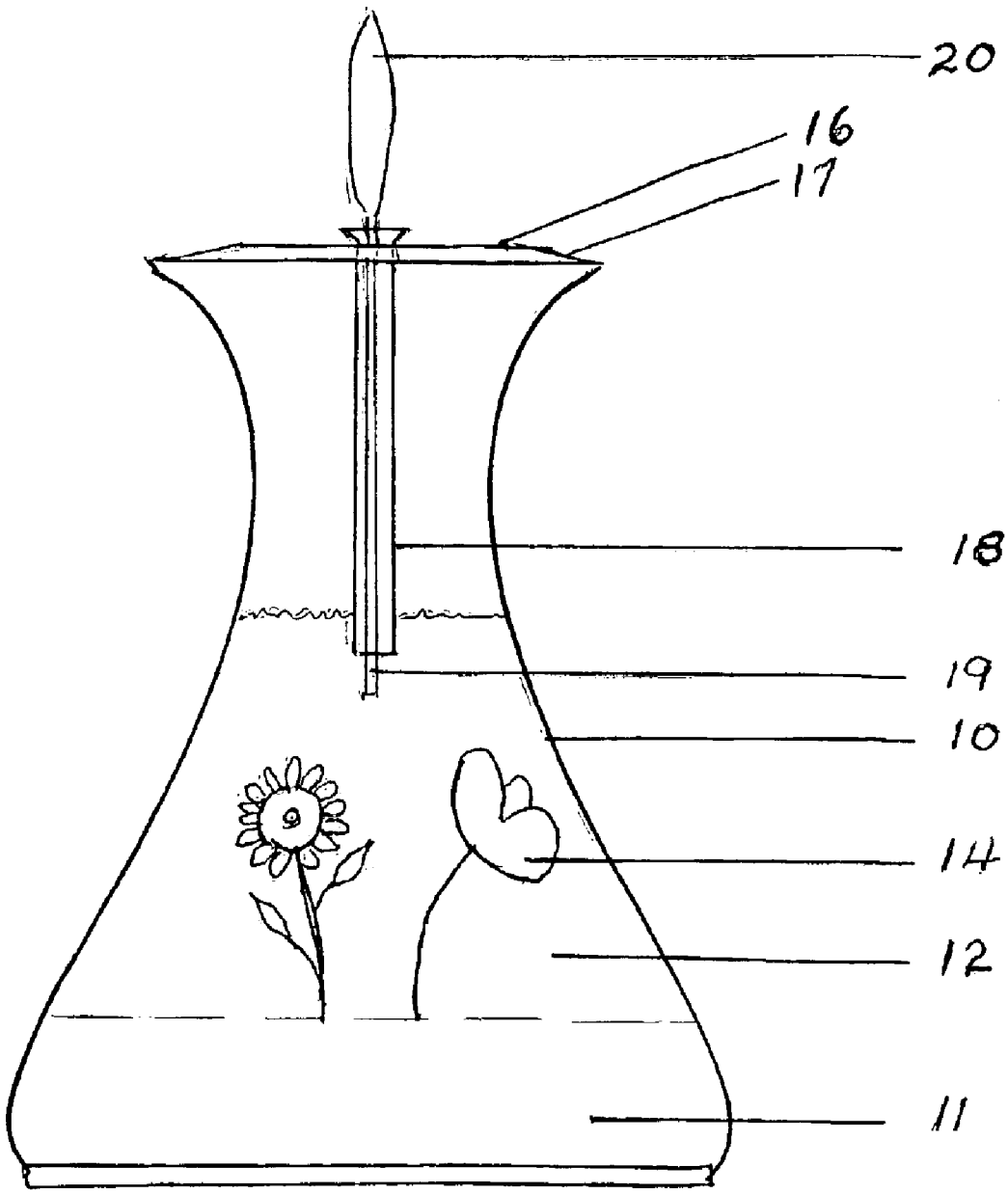
20
16
17
18
19
10
14
12
11

SELF-ILLUMINATING OIL CANDLE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

This invention relates to oil candles of the kind in which a glass vessel containing decorative materials and candle fuel is topped with a closure through which a wick extends into the enclosed fuel.

In the past, decorative oil candles have employed bottles with a neck portion as the aforesaid glass container and the decorative contents have been dried or silk flowers or objects which could be passed through the bottle neck. For the most part, the bottle closure through which the wick passed was a porcelain plug.

In other instances, the wick was contained in a slender glass cylinder which had an enlarged head which prevented it from dropping through the bottle neck. Where the bottle opening was larger than the enlarged head, a grommet with an external diameter large enough to span the opening and an interior diameter less than that of the enlarged head was placed over the opening.

Such oil candles were valued for their attractive appearance and utility. Appreciation of the appearance depended, however, on an adequate external source of light to illuminate the contents, and this was absent in twilight or dark outdoors or in dim light indoors, thus, undermining or completely defeating the decorative effect for which the candle was created in the first place.

BRIEF SUMMARY OF THE INVENTION

An object of this invention is to provide a decorative self-illuminating oil candle in which the appearance of the decorative material is brightly and visibly enhanced, and to a particularly pleasing and surprising extent in dim light, wherein the decorative effect of prior candles would go unnoticed.

I have found that the flame of the candle can be utilized to substantially illuminate the decorative contents of an oil candle by utilizing a transparent closure which extends without interruption from the wick or wick-holder where it passes through the closure to the margins of the glass container on which the closure is mounted. This allows sufficient light produced by the flame to pass into the interior of the container where, in combination with the magnifying effect of the oil, produces a surprisingly bright and enlarged image of the decorative contents.

BRIEF DESCRIPTION OF THE DRAWING

The FIGURE in the accompanying drawing is a view in elevation which illustrates a self-illuminating oil candle according to this invention.

DETAILED DESCRIPTION OF THE INVENTION

A glass vase 10 contains a candle oil 12. Such oil is known commercially as "candle and lamp oil" and is available at hardware stores or general merchandise stores selling candles of various kind. The vase 10 contains decorative material 14 which may include silk, glass or dried flowers or a figurine. These are preferably supported by a particulate material 11 to hold them in place. The top of vase 10 is closed off by a glass disc 16 which is fastened by gluing to the upper margins of vase mouth. The disc may be provided with a beveled edge 17 which aids in guiding some light into the center of the vase. This disc is provided with a central hole through which the wick holder 18 extends. The wick holder encloses a wick 19 which acts to draw oil to the flame from the oil mass 12. A small part of the wick extends above the top edge of the wick holder and it is this part which, when ignited, creates the flame 20. The light from the flame passes through the wholly transparent disc 16 and brightly illuminates the decorative contents 14.

What is claimed is:

1. An oil candle comprising candle oil encompassing decorative arrangements supported by a base of particulate material within a transparent glass container said container having side walls formed integrally with a flat bottom on which the aforesaid particulate material resides and having a circular top opening defined by the upwardly facing terminal edge of said side walls, said opening being covered by a separately formed glass disc fastened by glue to the aforesaid upwardly facing top edge to provide a sealed top for the container, said disc having a wick extending through it down into said oil and being transparent throughout the area of the top opening whereby the aforesaid decorative arrangements are brightly and visibily illuminated when the candle is lit.

2. An oil candle as described in claim 1 in which the transparent glass disc has a beveled edge which lies in part within the said top opening.

* * * * *